US006052831A

United States Patent [19]

Park

[11] Patent Number: 6,052,831

[45] Date of Patent: Apr. 25, 2000

[54] FREE-SIZE CAP

[75] Inventor: Boo Yl Park, Seoul, Rep. of Korea

[73] Assignee: DADA Corp., Seoul, Rep. of Korea

[21] Appl. No.: 09/239,832

[22] Filed: Jan. 29, 1999

[51] Int. Cl.[7] ..... A42B 1/22

[52] U.S. Cl. ..... 2/195.2; 2/175.1; 2/181.6; 2/182.8; 2/183; 2/195.3

[58] Field of Search ..... 2/175.1, 181, 181.2, 2/181.6, 182.8, 183, 195.2, 195.3, 418

[56] References Cited

U.S. PATENT DOCUMENTS

| | | | |
|---|---|---|---|
| 202,217 | 4/1878 | Bate | 2/175.1 |
| 223,177 | 12/1879 | Simis | 2/181.6 |
| 456,785 | 7/1891 | Webb | 2/181.6 |
| 1,724,071 | 8/1929 | Carlson | 2/181.2 |
| 2,106,075 | 1/1938 | Tabley | 2/181 |
| 4,023,212 | 5/1977 | Huffman | 2/197 |
| 4,141,229 | 2/1979 | Sharpe | 66/171 |
| 4,165,542 | 8/1979 | McLaughlin | 2/209.1 |
| 4,393,519 | 7/1983 | Nicastro | 2/12 |
| 4,491,985 | 1/1985 | Dalton | 2/171 |
| 4,551,859 | 11/1985 | Gerhardt | 2/172 |
| 4,608,721 | 9/1986 | Lipkin | 2/172 |
| 4,642,817 | 2/1987 | Ferstenfeld | 2/183 |
| 4,662,007 | 5/1987 | Lipkin | 2/195 |
| 4,845,782 | 7/1989 | Gregg | 2/172 |
| 5,012,532 | 5/1991 | Krystal | 2/197 |
| 5,070,545 | 12/1991 | Tapia | 2/195 |
| 5,119,514 | 6/1992 | Woehl | 2/195 |
| 5,153,939 | 10/1992 | Howe et al. | 2/69 |
| 5,161,260 | 11/1992 | Reynolds | 2/207 |
| 5,272,772 | 12/1993 | Hahn | 2/195.2 |
| 5,426,789 | 6/1995 | MacLeod | 2/183 |
| 5,428,843 | 7/1995 | Clowers et al. | 2/195.2 |
| 5,481,759 | 1/1996 | Rinaldi | 2/195.1 |
| 5,715,540 | 2/1998 | Cho | 2/195.3 |
| 5,862,522 | 1/1999 | Cho | 2/195.1 |

*Primary Examiner*—Diana Oleksa
*Attorney, Agent, or Firm*—Jacobson, Price, Holman & Stern, PLLC

[57] ABSTRACT

A free-size cap is capable of fitting wearers having a range of head sizes. The cap includes a multi-gore shell forming a crown portion, a headband having a plurality of slits thereon and a stretchable fabric interconnecting the crown and the headband. Further, a sponge-containing headband is secured to the lower peripheral edge of the crown by the stretchable fabric, and the headband is stretchable in accordance with stretching of the crown. The structure permits a cap to be designed which is produced easily, attractive in use or other time by keeping its shape, comfortable for the wearer by causing no oppression, and further provides the advantageous feature of multiple size capability.

22 Claims, 5 Drawing Sheets

FREE-SIZE CAP

FIELD OF THE INVENTION

The present invention relates generally to an improved cap structure, and more particularly to an improved free-size cap having a typical baseball configuration, and with one cap being adapted to accommodate a variety of sizes of heads.

BACKGROUND OF THE INVENTION

It shall be understood that caps of the baseball cap style are marketed in a variety of ways. These caps are marketed through conventional retail outlets, and have also found a substantial market as promotional items. In the marketing of outer wear products, it is, of course, more economical to provide such products with a minimal numbers of sizes. Thus, economy of numbers may be achieved through utilization of caps of the multi-size variety.

In addition to typical marketing, various types of business entities provide such promotional items to employees and/or customers, and in these instances, the outer surface of the crown at a point above the visor may carry an emblem, or other indicia identifying the business entity. Because of the manner in which these products are marketed, it is, of course, desirable to utilize the products with minimal size variation requirements, hence the free-size caps become extremely desirable for the customer.

As is conventional, baseball caps employ a crown portion to which a visor is secured to the forward edge of the crown and extends outwardly therefrom.

In utilization of caps for outer wear, it is desirable for the forward portion to be somewhat rigid so that, for appearance purposes, the crown portion stands somewhat erect. Also such an arrangement will normally provide a means for the visor portion to be rigid, durable, and extend generally forwardly of the wearer's forehead. Accordingly, the front gores or panels may be fitted and/or stiffened by suitable means in order to stand generally erect during wear.

In the past, attempts have been made to provide free-size cap structures of the baseball cap style, and such caps are in wide-spread use today. Typically, free-size caps are created through the utilization of a variable-length snap arrangement which permits the user to adjust the cap size as required. Such caps are frequently of the single or fixed size variety.

More recently, attempts have been made to provide free-size cap of the baseball cap type or style which does not utilize a variable-length snap arrangement. An example of such a cap is disclosed in U.S. Pat. No. 5,715,540 to B. W. Cho. In the Cho patent, a free-size cap comprises a main body having a plurality of gores forming a crown portion having a lower peripheral edge wherein at least some of the plurality of gores are composed of uniaxially stretchable fabric aligned to stretch only in a peripheral direction; and a sweat band connected to the lower peripheral edge of the crown portion, said sweat band being a single unfolded stretchable sheet in structure such as an elastic band so that it is adjustable together with the main body to fit various head sizes.

However, such caps cause a sense of oppression to the wearers since it uses a high elastic sweat band and does not keep its shape when not in use.

It is desirable to provide a cap which is more simply produced, attractive in use, comfortable for the wear by causing no oppression, and further provides the advantageous feature of multiple size capability. Such cap designs are utilized by individuals for a variety of outdoor purposes, including work purposes as well as sport purposes, including such sports as hunting, fishing, and the like.

SUMMARY OF THE INVENTION

Therefore, it is a primary object of the present invention to provide an improved baseball-type cap for fitting multiple sizes which includes the crown portion composed of a plurality of gores and being expansible at least in the peripheral direction thereof, and headband being made of the fabric capable of absorbing the sweat or the like. The headband is secured to the lower edge of the crown by means of biaxially stretchable fabric.

It is a further object of the present invention to provide a baseball-type cap structure capable of multi-size use, which can be manufactured easily utilizing conventional materials and fabrics, and which is both functional and attractive in its use and appearance.

It is yet a further object of the present invention to decrease the quantity of stock in a manufacturing or in a selling agency due to the wider accommodation range of the cap.

In order to achieve the foregoing objects, the present invention provides a free size cap comprising a main body having a plurality of gores forming a crown portion having a lower peripheral edge. The lower peripheral edge of the crown is expandible at least in the peripheral direction thereof and a headband is made of a non-stretchable fabric capable of absorbing sweat or the like. The headband has a plurality of slits which are incised in a vertical direction of the headband and are attached to the lower edge of the crown by means of biaxially stretchable fabric. The fabric used for the headband may be cut in a bias direction.

In accordance with a preferred embodiment of the present invention, at least some gores forming the crown portion of the main body is made of uniaxially or biaxially stretchable fabrics.

In accordance with another preferred embodiment of the present invention, gores forming the crown portion of the main body are made of non-stretchable fabrics while some of the gores are connected be means of flexible seam made of biaxially stretchable fabric so that the lower edge of the crown is expansible at least in a peripheral direction.

In accordance with another preferred embodiment of the present invention, a flexible material like a sponge, may be contained inside the headband.

Furthermore, in accordance with the present invention, the problem in the prior art is improved that the height of the crown is lowered as the circumference thereof becomes wider.

Other and further objects of the present invention will become apparent to those skilled in the art on consideration of the accompanying drawings and following specification wherein are disclosed several exemplary embodiments of the invention with the understanding that such variations, modifications and elimination of parts may be made therein as fall within the scope of the appended claims without departing from the spirit of the invention.

BRIEF DESCRIPTION OF THE DRAWINGS

FIG. 1-1 is an enlarged view of the portion B in FIG. 1, FIG. 2-1 is an enlarged view of the portion (a) of FIG. 1 and FIG. 2 when the crown is elongated, FIG. 5-1 is an enlarged view of the portion (b) of FIG. 4 and FIG. 5 when the crown is elongated.

DESCRIPTION OF THE PREFERRED EMBODIMENT

Figure 1:
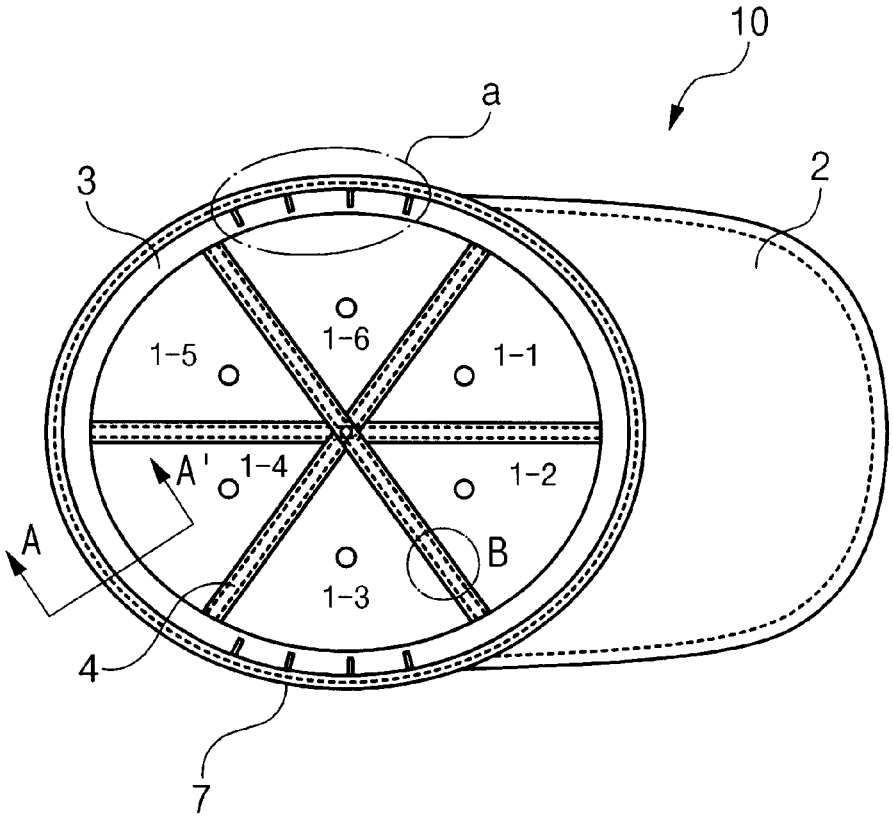
FIG. 1 is a bottom view of the free-size cap in accordance with a preferred embodiment of the present invention showing the interior of the crown portion of the cap.
Figure 1:
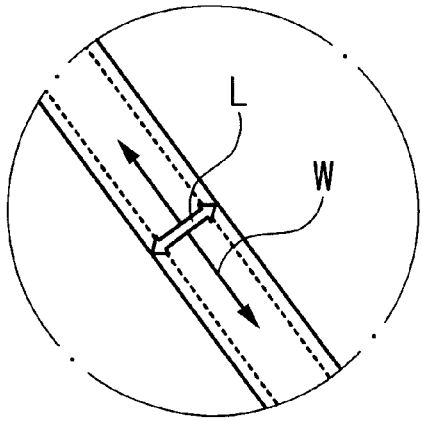
Figure 2:
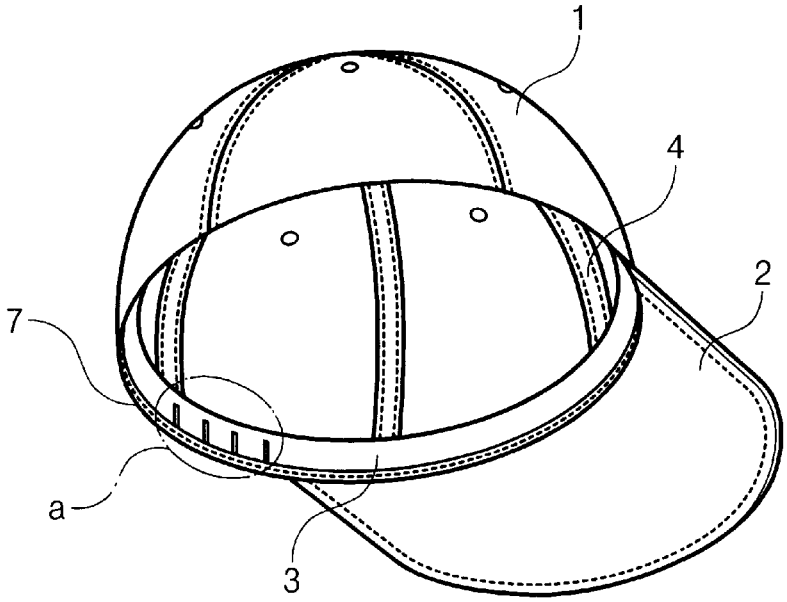
FIG. 2 is a perspective view of the free-size cap of FIG. 1.
Figures 1, 2:
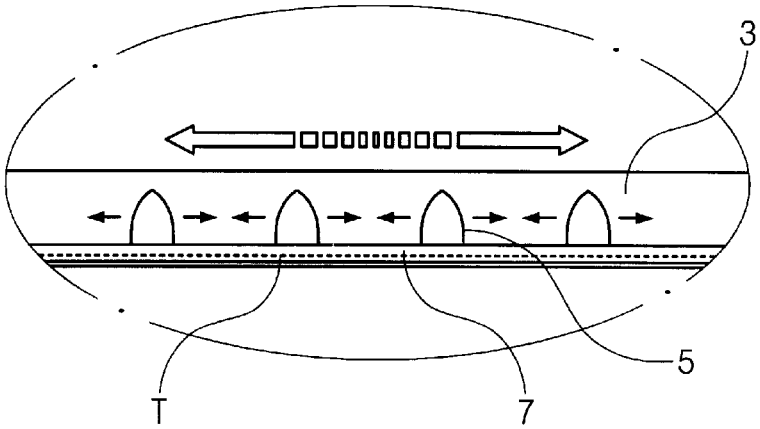
Figure 3:
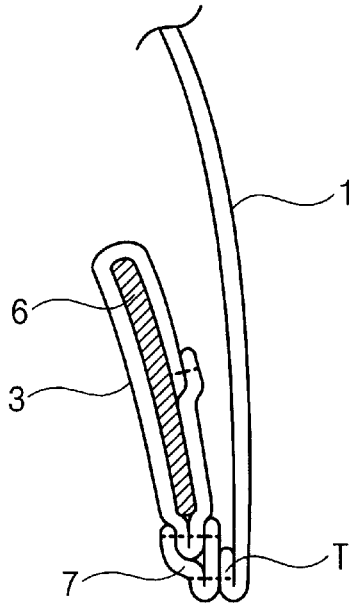
FIG. 3 is an enlarged cross-sectional view taken along line A—A' of FIG. 1.

In accordance with a preferred embodiment of the present invention, and with particular attention directed to FIGS. 1 through 3, a free-size cap structure generally designated by 10 includes a crown 1 which is fabricated with several fabric segments(panels or gores) 1-1, 1-2, 1-3, 1-4, 1-5 and 1-6. Secured to the front portion of the crown is a visor 2 extending away from the crown 1 at a desirable angle or tilt. The visor, as previously indicated, is normally somewhat rigid, and hence is not stretchable.

A crown 1 is formed of individual gores such as gores 1-1. 1-2, 1-3, 1-4, 1-5, and 1-6, which are fabricated with a uniaxially or a biaxially stretchable fabric. As illustrated in FIG. 1-1, each edge of the gores is sewn together with a bias tape 4 made of biaxially stretchable fabric so that the stretchability of the crown is enhanced. Thus, bias tape 4 is stretchable along its length Z and width W.

In the present invention, a headband 3 is connected along the lower peripheral edge of the crown 1. In the present invention, however, as the most distinguishable feature, a plurality of slits 5 are incised in a vertical direction of the headband, as shown in FIG. 1 and FIG. 2. In addition, the headband 3 and the crown 1 are connected by means of a uniaxially or biaxially stretchable narrow stripe 7.

The headband 3 may be made of non-stretchable fabric cut in a bias direction or a normal direction. The slit 5 provided on the headband is incised in a vertical direction of the headband. It is preferable that the slit 5 may be formed on the headband starting from the edge of the head band to which the stretchable narrow stripe 7 is attached and ending within the width of the headband so that the upper edge of the headband remains continuous and un-incised. Namely, the slit 5 could be incised starting from a certain point within the width of the headband and extended to the lower edge of the headband to which a biaxially stretchable narrow stripe 7 is connected, thereby maximizing the stretchability of the lower edge of the crown 1. It is possible that the slits 5 are formed on any position of the headband, however, it is preferable that the slits 5 are formed on the position of the headband being connected to gores 1-3 and 1-6. It is not necessary to form the slits on the position of the headband connected to gores 1-1 and 1-2 since visor 2 is rigid and therefore prevents expansion.

FIG. 3 illustrates the attaching section of the crown 1, headband 3 and the biaxially stretchable narrow stripe 7 which interlinks the former items in detail.

Each seam of the crown 1 and the stripe 7, and of the stripe 7 and the headband 3 are preferably sewn with the elastic thread T. A flexible material, such as a sponge 6, may be inserted inside the headband 3 to improve the wearing comfort of the free-size cap as well as keeping the shape of the cap.

The headband 3 may be fabricated with any suitable material being capable of absorbing sweat or the like.

Figure 4:
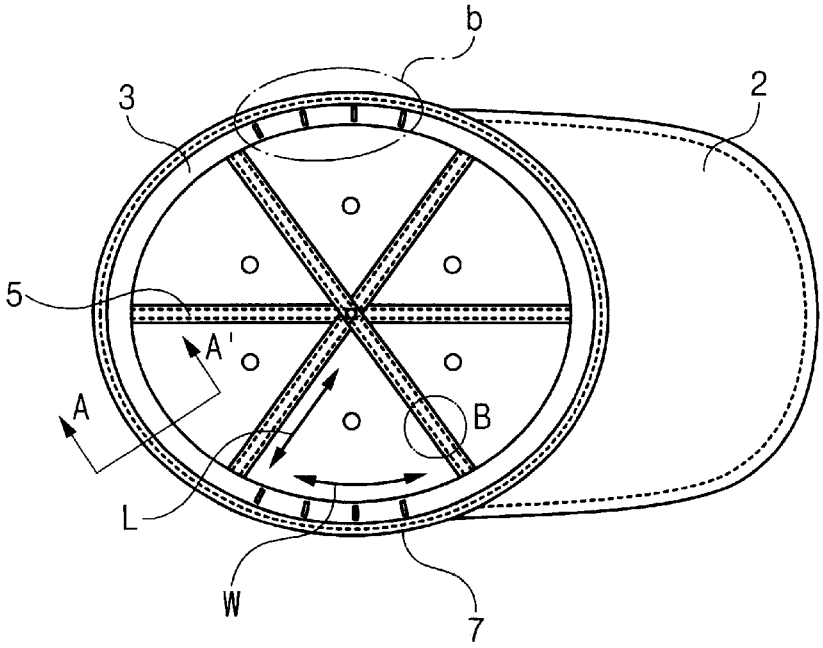
FIG. 4 is a bottom view of the free-size cap in accordance with another preferred embodiment of the present invention showing the interior of the crown portion of the free-size cap of the present invention.
Figure 5:
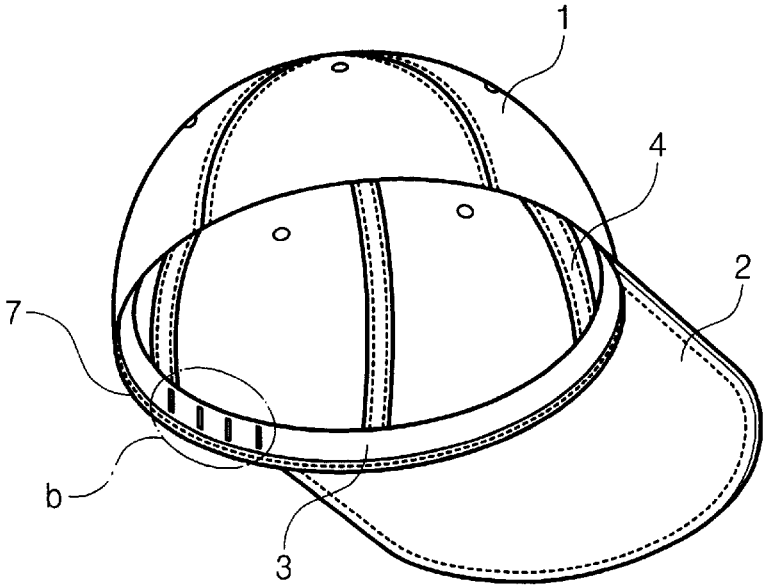
FIG. 5 is a perspective view of the free-size cap of FIG. 4.
Figures 1, 5:
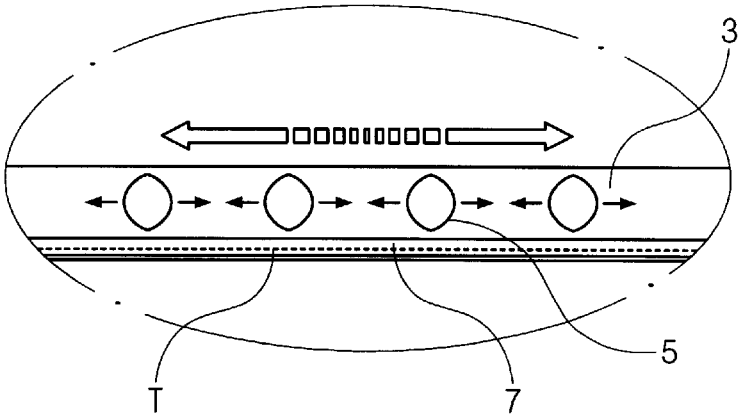

FIGS. 4 through 5-1 show another embodiment of the present invention. In this embodiment, the slit 5 is formed only within the width of the headband so that the upper end and the lower end of the slit 5 remain un-incised. According to this embodiment, the slit forms a button-hole like shape when it is stretched. As like the aforementioned embodiment, in this embodiment, a flexible material as like a sponge 6 may be inserted inside the headband 3 to improve the wearing comfort of the free-size cap as well as keeping the shape of the cap.

Figure 6:
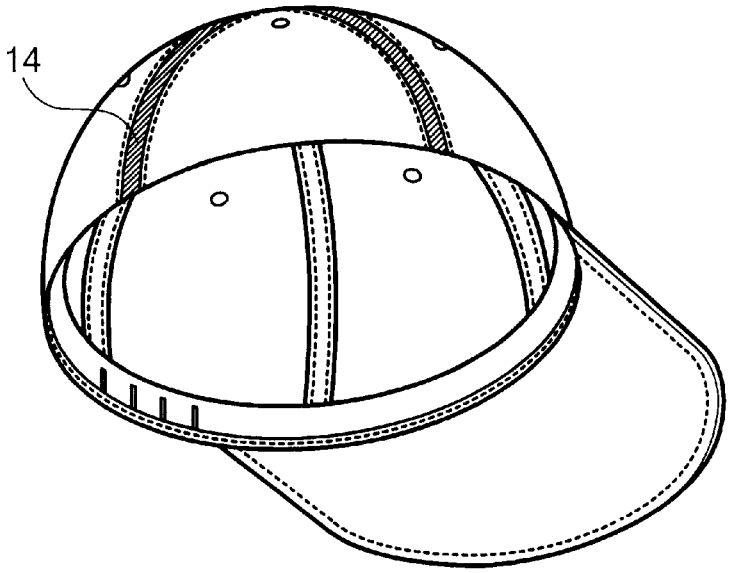
FIG. 6 shows a free-size cap in accordance with an alternative preferred embodiment of the present invention.

FIG. 6 shows another embodiment of the present invention which adopts a different type of crown than that of the aforementioned embodiments. In this embodiment, a main body has a plurality of gores forming a crown portion having a lower peripheral edge. At least some of said plurality of gores are connected by stretchable material aligned to stretch at least in the peripheral direction so that the material functions as a flexible seam 14. The gores may be made of stretchable or non-stretchable fabrics. The non-stretchable fabrics used for the gores may be cut in a bias direction or a normal direction.

Figure 7:
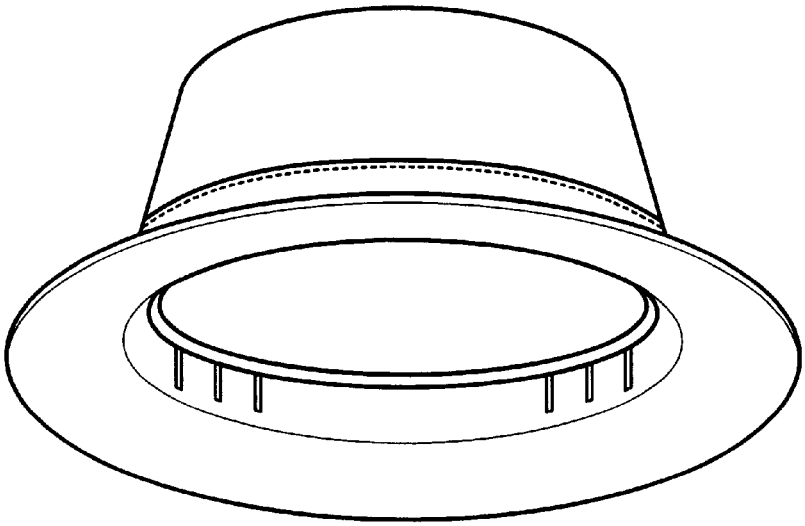
FIG. 7 shows another alternative preferred embodiment of the present invention applied to a hat or a trilby.

It shall be noted that even though the invention is described for a baseball-type cap in the above stated preferred embodiments, the technical concept of the present invention is also applicable to any other head wear, like a hat or a trilby, as shown in FIG. 7.

Furthermore it will be appreciated that various modifications of the present invention may be undertaken by those skilled in the art without departing from the spirit and scope hereof.

What is claimed is:

1. A free-size cap comprising:

a main body having a plurality of gores forming a crown portion with a lower peripheral edge, wherein the lower peripheral edge of the crown is expandable at least in a peripheral direction thereof, and a headband made of a non-stretchable absorbent fabric, said headband having a plurality of slits which are each incised substantially normal to a longitudinal direction of the headband, the headband attached to the lower peripheral edge of said crown by a biaxially stretchable fabric.

2. The free-size cap as claimed in claim 1, wherein at least one or more of said plurality of gores are fabricated with a stretchable material so that the lower peripheral edge of the crown is expandable at least in the peripheral direction.

3. The free-size cap as claimed in claim 1, wherein said plurality of gores are fabricated with a non-stretchable material, and a lower edge of at least one or more of said gores is connected with a stretchable material so that the lower edge of the crown is expandable at least in the peripheral direction.

4. The free-size cap as claimed in claim 1, wherein at least one of said slits is formed on said headband starting from an attached edge of the headband to which the biaxially stretchable fabric is attached and ending within a width of said headband so that an open edge of said headband is continuous.

5. The free-size cap as claimed in claim 1, wherein at least one of said slits is formed only within a width of the headband so that an upper end and lower end of the slit are continuous.

6. The free-size cap as claimed in claim 1, wherein a flexible material is inserted in said headband.

7. The free-size cap as claimed in claim 6, wherein said flexible material is a sponge.

8. A headwear comprising:

a main body having a plurality of panels forming a crown portion with a lower peripheral edge, wherein the lower peripheral edge of the crown is expandable at least in a peripheral direction thereof, and a headband made of a non-stretchable fabric, said headband having a plurality of slits incised in the headband, the headband attached to the lower peripheral edge of said crown by a biaxially stretchable fabric.

9. The free-size cap as claimed in claim 8, wherein at least one or more of said plurality of panels are fabricated with a stretchable material so that the lower peripheral edge of the crown is expandable at least in the peripheral direction.

10. The free-size cap as claimed in claim 8, wherein said plurality of panels are fabricated with a non-stretchable material, and a lower edge of at least one or more of said panels is connected with a stretchable material so that the lower edge of the crown is expandable at least in the peripheral direction.

11. The free-size cap as claimed in claim 8, wherein at least one of said slits is formed on said headband starting from an attached edge of the headband to which the biaxially stretchable fabric is attached and ending within a width of said headband so that an open edge of said headband is continuous.

12. The free-size cap as claimed in claim 8, wherein at least one of said slits is formed only within a width of the headband so that an upper end and lower end of the slit are continuous.

13. The free-size cap as claimed in claim 8, wherein a flexible material is inserted in said headband.

14. The free-size cap as claimed in claim 13, wherein said flexible material is a sponge.

15. A headwear comprising a main body having a plurality of panels forming a crown portion with a lower peripheral edge which is expandable at least in a peripheral direction, and a non-stretchable headband having a plurality of slits, the headband attached to the lower peripheral edge of said crown.

16. The headwear of claim 15, further comprising a biaxially stretchable fabric connected to the headband and to the lower peripheral edge of said crown.

17. The free-size cap as claimed in claim 16, wherein at least one of said slits is formed on said headband starting from an attached edge of the headband to which the biaxially stretchable fabric is attached and ending within a width of said headband so that an open edge of said headband is continuous.

18. The free-size cap as claimed in claim 15, wherein at least one or more of said plurality of panels are fabricated with a stretchable material so that the lower peripheral edge of the crown is expandable at least in the peripheral direction.

19. The free-size cap as claimed in claim 15, wherein said plurality of panels are fabricated with a non-stretchable material, and a lower edge of at least one or more of said panels is connected with a stretchable material so that the lower edge of the crown is expandable at least in the peripheral direction.

20. The free-size cap as claimed in claim 15, wherein at least one of said slits is formed only within a width of the headband so that an upper end and lower end of the slit are continuous.

21. The free-size cap as claimed in claim 15, wherein a flexible material is inserted in said headband.

22. The free-size cap as claimed in claim 21, wherein said flexible material is a sponge.

* * * * *